US006481654B1

(12) United States Patent
Balvanz et al.

(10) Patent No.: US 6,481,654 B1
(45) **Date of Patent: *Nov. 19, 2002**

(54) SADDLE-BACK HAMMER AND HAMMER TIP

(75) Inventors: Loran Balvanz, New Providence, IA (US); Paul Gray, New Providence, IA (US)

(73) Assignee: U.S. Manufacturing, Inc., New Providence, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/666,360

(22) Filed: Sep. 20, 2000

(51) Int. Cl.[7] ..... B02C 13/02
(52) U.S. Cl. ..... 241/191; 241/295; 241/297
(58) Field of Search ..... 241/191, 195, 241/197, 300

(56) References Cited

U.S. PATENT DOCUMENTS 3,680,797 A * 8/1972 Covey ..... 241/191
4,136,933 A * 1/1979 Knight ..... 241/194
5,285,974 A 2/1994 Cesarini
5,307,719 A 5/1994 MacLennan
5,704,562 A * 1/1998 Wagstaff ..... 241/221
5,941,467 A * 8/1999 McArdle et al. ..... 241/187
5,967,436 A * 10/1999 Balvanz ..... 241/195
6,079,649 A * 6/2000 Balvanz et al. ..... 241/189.1
6,131,838 A * 10/2000 Balvanz et al. ..... 241/195
6,142,400 A * 11/2000 Balvanz et al. ..... 241/191
6,311,910 B1 * 11/2001 Balvanz et al. ..... 241/191

* cited by examiner

*Primary Examiner*—William Hong
(74) *Attorney, Agent, or Firm*—Daniel A. Rosenberg; Kent A. Herink; Davis Brown Law Firm

(57) ABSTRACT

A mated hammer and hammer tip combination for releasable engagement are provided. The hammer includes a lower body portion for engagement with a rotor of a size reducing machine, and an upper body portion. The upper body portion of the hammer includes at least one bolt hole and a front face having a raised center section. The hammer also includes an upper and lower ledge, and recessed side grooves. The hammer tip includes a front face with a distally located working edge for debris impact, at least one bolt hole for receipt of a bolt to releasably engage the hammer and hammer tip, and a back having a plurality of protruding opposable members, comprised of opposable shoulders or feet that define a recessed section therebetween forming a saddle-back. The saddle-back in the back of the hammer tip releasable engages with the raised center section of the hammer. The hammer tip and hammer are precision milled to ensure that the fit between the saddle-back of the hammer tip and the raised center section of the hammer is of a tolerance that is less than the tolerance between the bolts and bolt holes.

12 Claims, 5 Drawing Sheets

SADDLE-BACK HAMMER AND HAMMER TIP

INCORPORATION BY REFERENCE

Co-pending U.S. patent application Ser. No. 09/326,209, now U.S. Pat. No. 6,131,838, filed on Jun. 4, 1999, entitle SADDLE-BACK HAMMER TIP, is hereby incorporated by reference.

BACKGROUND OF THE INVENTION

1. Field of Invention

The present invention relates to a mated hammer and hammer tip for releasable engagement with each other. In particular, to a hammer tip having a back portion comprised of two opposing shoulder-sections with a recessed section therebetween forming a saddle-back for releasable engagement with a face of the hammer formed by an upper and lower ledge and a raised center portion therebetween.

2. Background

In the art of construction of size reducing machines like rotary hammermills, tub grinders, vertical and horizontal feed machines, and the like, one of the most persistent problems faced by designers and operators of such equipment comprises properly releasably securing or engaging the hammer tips to the hammers. In the prior art, the sole method for attaching a hammer tip to a hammer involved merely inserting one or two threaded bolts through a bolt hole in the hammer tip and hammer then securing the bolt with a threaded nut. After a certain period of operational time, the hammer tip wears to the point of requiring replacement, which is accomplished through removal of the nut and bolt.

During this normal operation of the size reducing machine, however, the hammer tips come into frequent and violent contact with the product being size reduced. This places stress of all types from all directions on the hammer tip, and the hammer. Frequently, the striking force inflicted on the hammer tip begins to laterally torque, rotate, or twist the hammer tip, which eventually begins to peen the bolt holes. The twisting or rotational force on the hammer tip begins to force the bolts and bolt heads against the bolt hole introducing play. The additional play allows the bolt to move which will loosen the nut, or otherwise introduce movement between the hammer tip and the hammer. Once loosened, the play introduced will cause the bolt to break and prematurely disengage from the hammer, or otherwise come loose throwing the hammer tip into the machine.

A lose hammer tip in the machine can result in substantial damage to any exposed surface of the size reducing machine. In addition, with the hammer tip removed from the face of the hammer, the hammer quickly receives substantial unintended wear that can permanently damage the hammer. The replacement of a hammer comprises a significant detriment to the efficient operation of a size reducing machine. Furthermore, in most cases a hammer tip is thrown from the hammer well before the hammer tip needs replacement from normal wear.

Accordingly, a need exists in the art for better way of engaging hammer tips and hammers in a releasably securable manner.

SUMMARY OF THE INVENTION

An object of the present invention comprises providing a hammer and hammer tip combination for releasable mated engagement with each other that substantially reduces the chance of the hammer tip prematurely separating from the hammer.

These and other objects of the present invention will become apparent to those skilled in the art upon reference to the following specification, drawings, and claims.

The present invention intends to overcome the difficulties encountered heretofore. To that end, a mated hammer and hammer tip combination for releasable engagement are provided. The hammer includes a lower body portion for engagement with a rotor of a size reducing machine, and an upper body portion. The upper body portion of the hammer includes at least one bolt hole and a front face having a raised center section. The hammer tip includes a front face with a distally located working edge for debris impact, at least one bolt hole for receipt of a bolt to releasably engage the hammer and hammer tip, and a back having a plurality of protruding opposable members with a recessed section therebetween forming a saddle-back. The saddle-back in the back of the hammer tip releasable engages with the raised center section of the hammer.

DETAILED DESCRIPTION OF THE INVENTION

Figure 2:
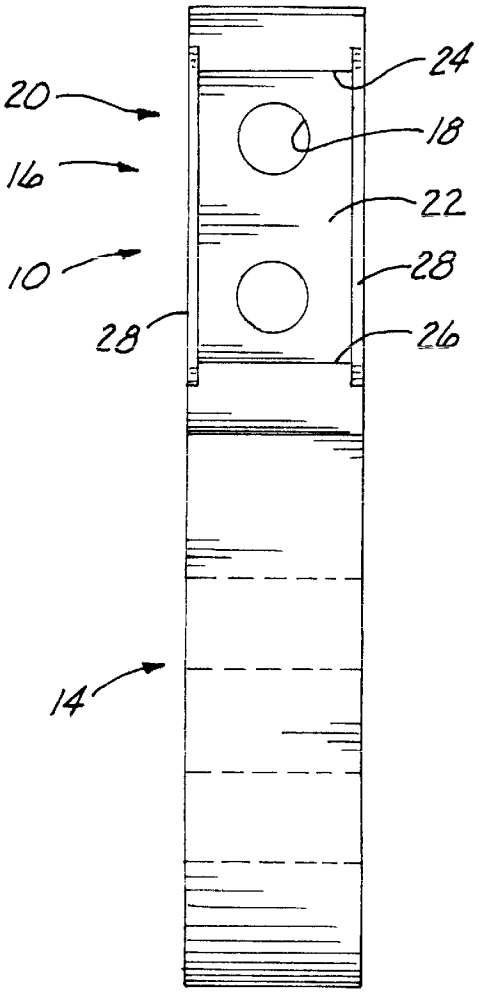
FIG. 2 shows a front view of the hammer of FIG. 1.
Figure 1:
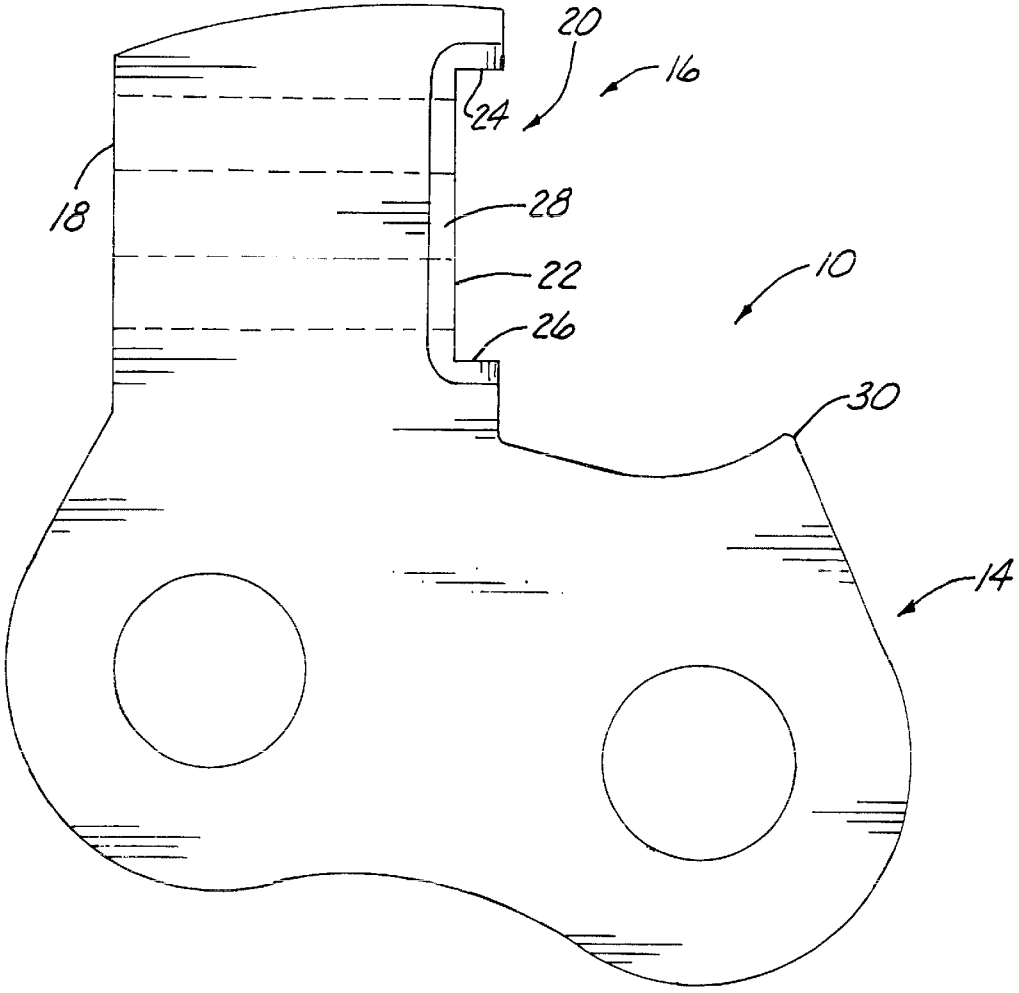
FIG. 1 show a side view of a hammer.
Figure 5:
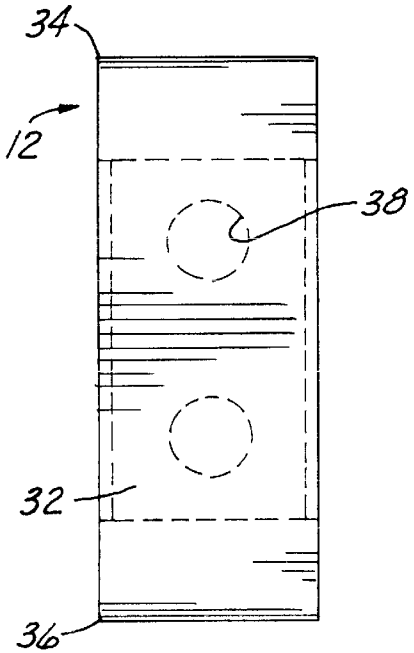
FIG. 5 shows a front view of the hammer tip of FIG. 3.
Figure 4:
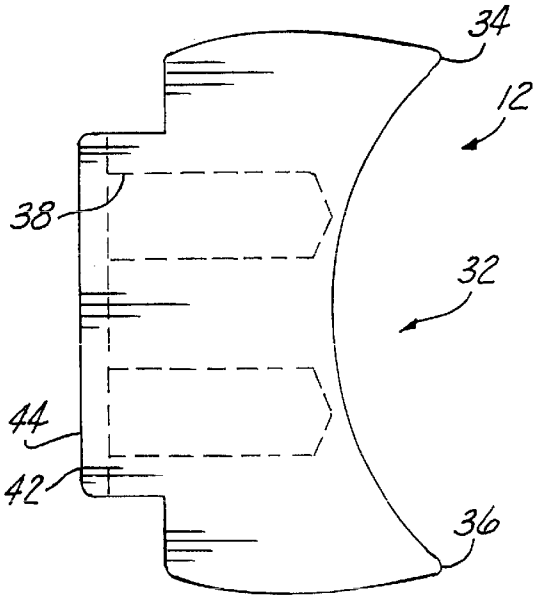
FIG. 4 shows a side view of the hammer tip of FIG. 3.
Figure 3:
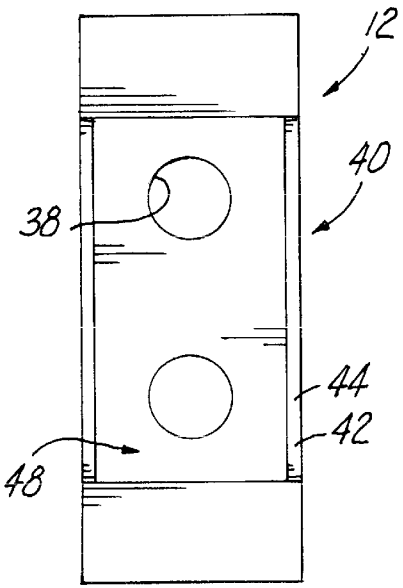
FIG. 3 shows a back view of a hammer tip.
Figure 6:
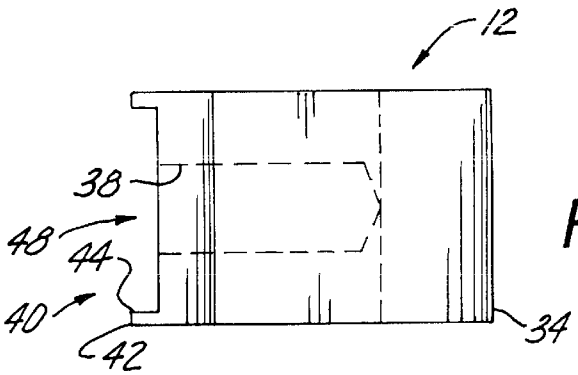
FIG. 6 shows a top view of the hammer tip of FIG. 3.
Figure 8:
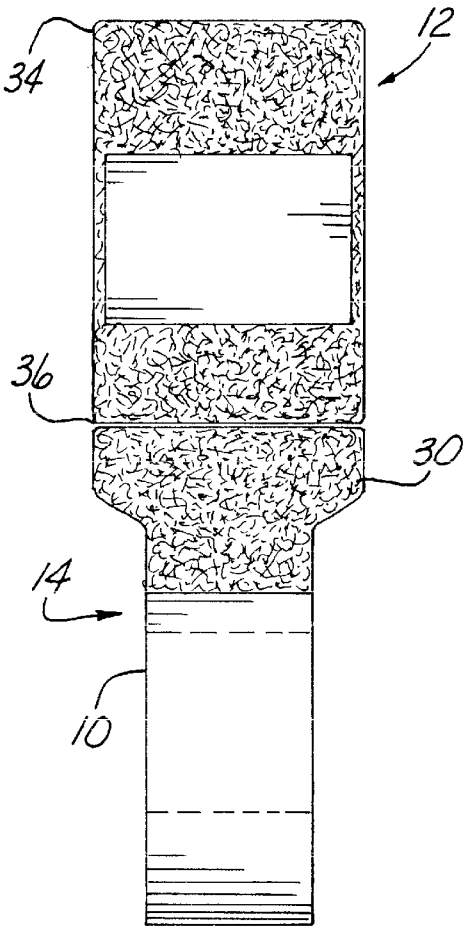
FIG. 8 shows a front view of the hammer and hammer tip combination FIG. 7.

In the figures, FIG. 1 shows a hammer 10 with a lower body portion 14, and an upper body portion 16. The lower body portion 14 of the hammer 10 is designed to attach to the rotor 50 of a size-reducing machine (not shown). The hammer 10 can be of a type that welds to a drum rotors, or used pins and rods to secure to the rotor. The upper body portion 16 of the hammer 10 includes a front face 20 and at least one bolthole 18. In the preferred embodiment of the present invention the front face 20 of the hammer 10 is designed for mated and releasable engagement with a hammer tip 12 (FIG. 2). In particular, as will be described in detail herein below, the front face 20 of the hammer tip 10 is shaped for mated alignment with a saddleback 48 of a back 40 of the hammer tip 12.

The front face 20 of the hammer 10 includes a raised center section 22. The raised center section 22 is defined on the top and bottom by a protruding upper ledge 24 and a lower ledge 26. Additionally, the raised center section 22 of the hammer 10 is further defined by recessed side grooves 28 precision milled into either side of the front face 20.

Figure 7:
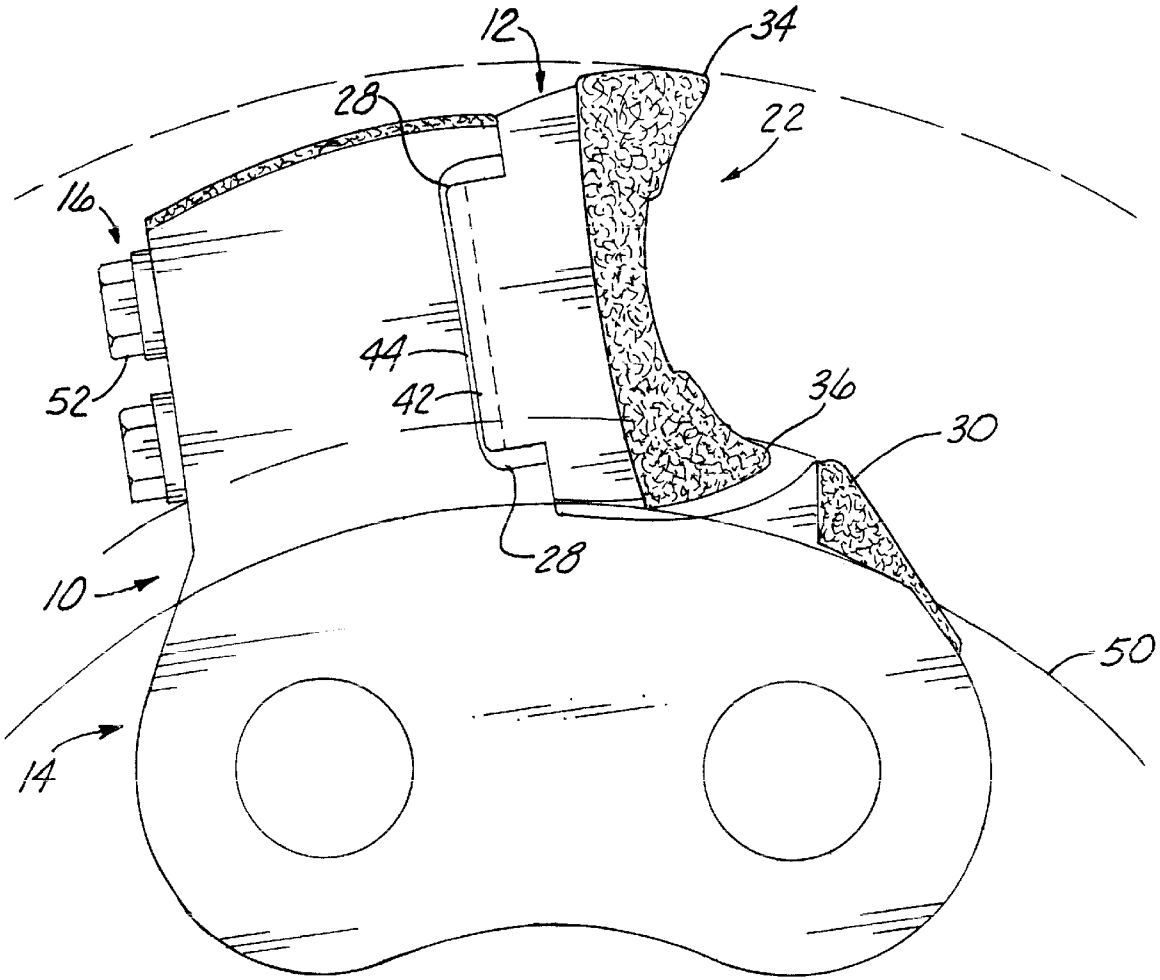
FIG. 7 shows a side view of a hammer and hammer tip combination.

Shown best in FIG. 7, the hammer tip 12, which includes a front face 32, is designed for releasable mated engagement with the hammer 10 in a manner that allows a working edge 34 to extend into a debris path during operation of the size-reducing machine. In the preferred embodiment of the invention the hammer tip 12 also includes a protected edge 36 that, during operation, recessed behind a production pocket 30 built into the lower body portion 14 of the hammer 10. The production pocket 30 serves to deflect debris away from the protected edge 36 of the hammer tip 12 and upward towards the working edge 34. Once the wear resistant coating (designated by shading) becomes sufficiently worn, the hammer tip 12 is reversed to expose the protected edge 36, thereby doubling the life of the hammer tip 12. Removing the hammer tip 12 is accomplished by removing the nuts 52 from the back of the hammer tip 10 that allows for removal of the bolts (not shown). The bolts extend through boltholes 18 in the upper body portion 16 of the hammer 10 and boltholes 38 in the hammer tip 12.

Figure 10:
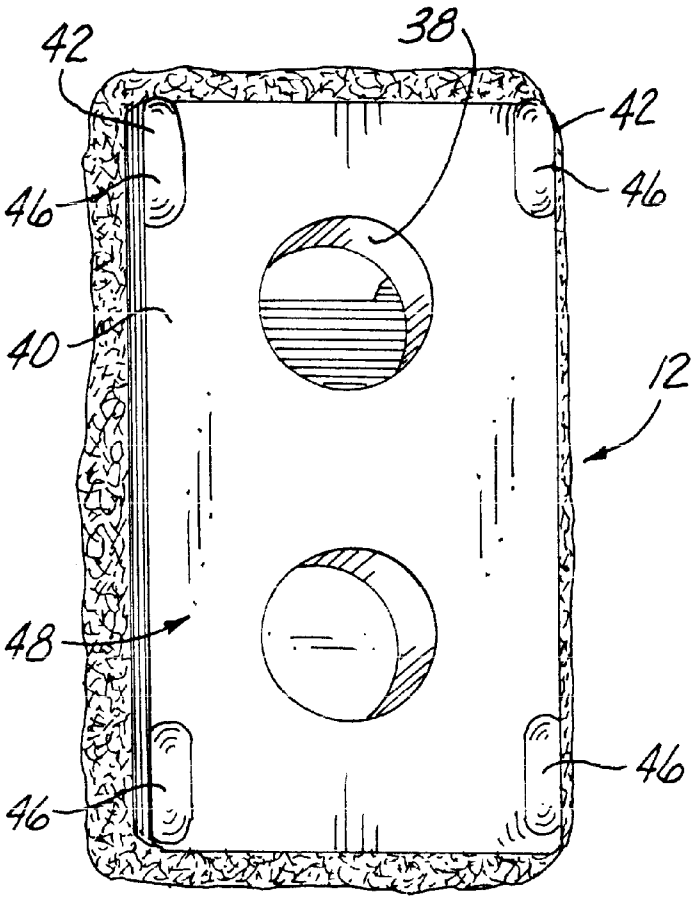
FIG. 10 shows a back view of an alternative hammer tip.
Figure 9:
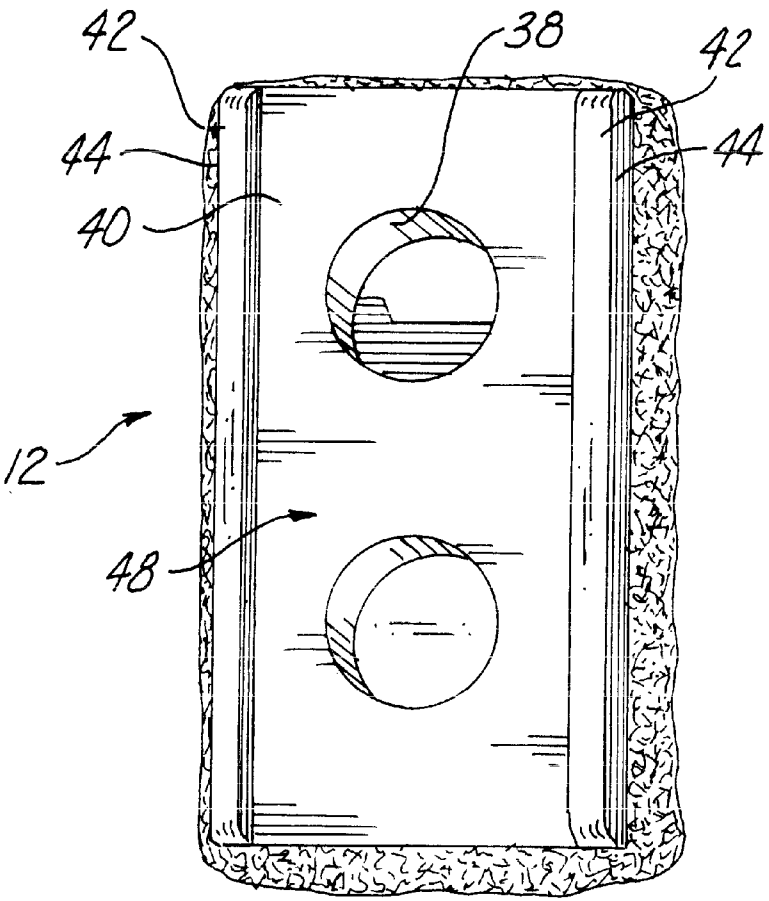
FIG. 9 shows back view of a hammer tip.

Referring to FIGS. 3–6, the hammer tip 12 includes a saddle back 48 created for mated engagement with the raised center section 22 of the hammer 10. The saddleback 48 is formed between opposing protruding members 42 located on the back 40 of the hammer tip 12. In the embodiment of the invention shown in FIGS. 3–6, 9, the protruding members 42 comprise shoulders 44. The shoulders 44 extend vertically from the top of the hammer tip 12 to the bottom. In the embodiment of the invention shown in FIG. 10, the protruding members 42 consist of feet 46 located in the perimeter comers of the back 40 of the hammer tip 12. The saddleback 48 consists of the recessed portion lying between the protruding members 42.

In this manner, the saddleback 48 of the hammer tip 12 fits into mated releasable engagement with the raised center section 22 of the upper body portion 16 of the hammer 10 (see FIG. 7). The saddleback 48 of the hammer tip 12 and the recessed side grooves 28 of the hammer 10 are precision milled to create a tight fit between the hammer tip 12 and the hammer 10. In particular, the fit between the hammer tip 12 and the hammer 10 should be such that the gap between the protruding members 42 of the hammer tip 12 and the sides of the upper body portion 16 immediately adjacent to the front face 20 of the hammer 10, defined by the recessed side grooves 28, combined with the gap between the top and bottom of the hammer tip 12 and the upper ledge 24 and lower ledge 26, is less than the gap between the bolts and the bolt holes 38 of the hammer tip 12. This will ensure that whatever minimal play that exists between the hammer tip 12 and the hammer 10 is insufficient to allow the bolt head to contact or impinge on the bolt hole 38 of the hammer tip 12. This will prevent the peening of the bolt holes or the loosening of the nut 152 securing the bolt, which can result in the sheering of the bolt. The entirety of the rotational, twisting, side-to-side, and upward and downward force experienced by the hammer tip 12 is absorbed by the hammer 10 and the hammer tip 12, rather than the bolt, bolt head, or bolt holes.

Figure 11:
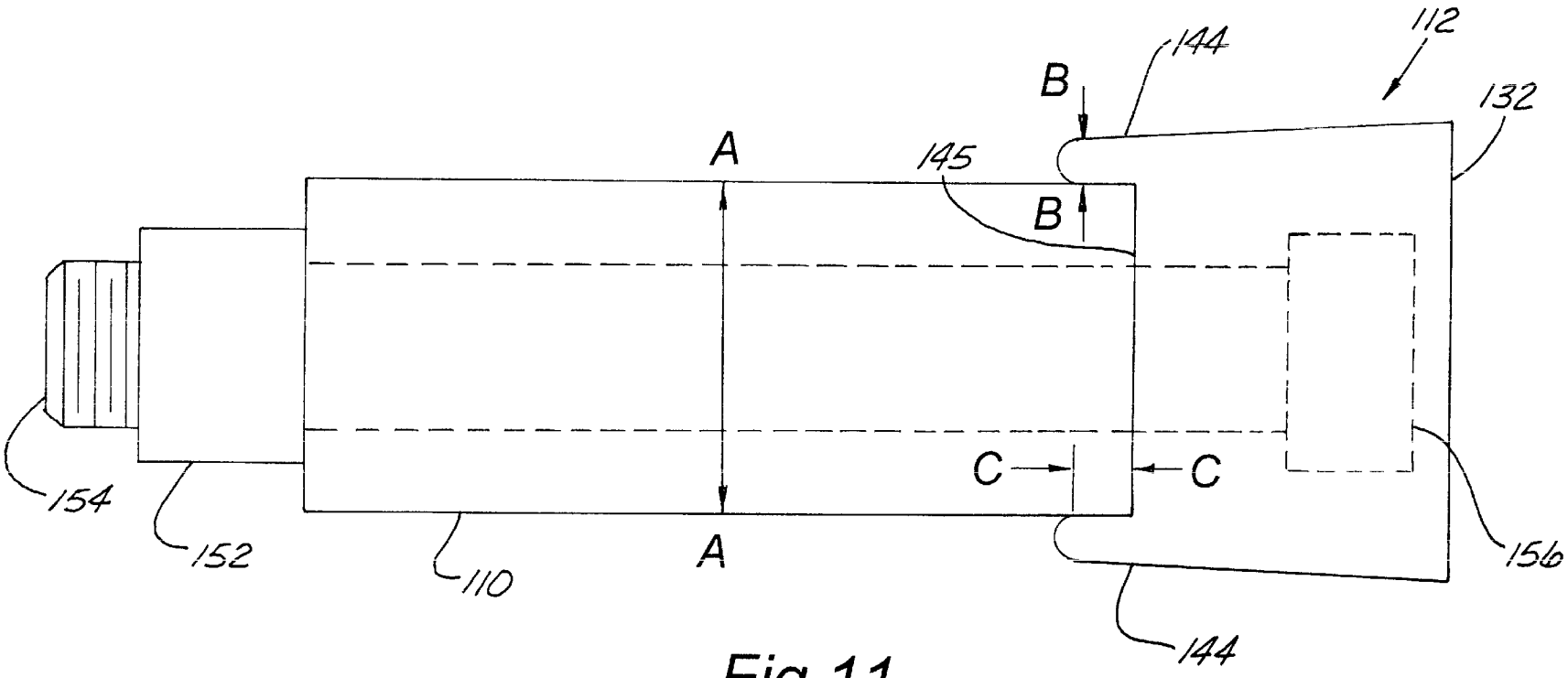
FIG. 11 shows a top view of a hammer and hammer tip combination.

FIG. 11, shows a hammer 110 substantially identical to the hammer 10 shown in FIGS. 1–10, except that the hammer 110 does not include the recessed side grooves 28 of the hammer 10. A bolt 156 and nut 152 combination secures the hammer 110 and tip 112. The nut 152 secures to the threaded end 154 of the bolt 156. For illustrative purposes, the hammer 110 and hammer tip 112 show a preferred specific dimensional design that best prevents the type of rotating and twisting motion that can result in a thrown hammer tip 10, 110. In particular, if the hammer width is defined as the distance on either side of the arrows marked AA in FIG. 11, the width of the shoulders 144 should be at least 12% of the hammer width. In other words, the distance between arrows BB in FIG. 11 should equal at least 12% of the hammer width AA. Further, the saddle-back 148 lying between the opposing shoulders 144 should have a depth of at least 12% of the hammer width. The depth of the saddle-back 148 shown in FIG. 11 is the distance between the arrows CC.

While the relationships disclosed hereinabove are preferred, the advantage of the present invention is not necessarily so restricted. For example, the hammer tip 12, 112 can vary in width such that the hammer tip 12, 112 extends beyond the edge of the hammer 10, 110. This results from the presence of the recessed side grooves 28 in the hammer 10. As long as the grooves 28 are of a sufficient depth to provide for mated engagement of the hammer tip 12 and the hammer 10, the hammer tip 12 can be wider than the hammer 10.

Those of ordinary skill in the art will realize that the specific mated arrangement of the hammer 10 and hammer tip 12 can be altered without departing from the scope of the intended invention. In particular, the saddle-back 48 could be located on the hammer 10 and the raised center section 22 located on the hammer tip 12 and still achieve mated releasable engagement between the hammer 10 and hammer tip 12.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

What is claimed is:

1. A mated hammer and hammer tip combination for releasable engagement with each other, said combination comprising:

a hammer comprising:
- a lower body portion for engagement with the rotor of a size reducing machine;
- an upper body portion comprising:
  - at least one bolt hole;
  - a front face having a raised center section;

a hammer tip comprising:
- a front face having a distally located working edge;
- at least one centrally located bolt hole for receipt of a bolt for releasable engagement of said hammer tip and said hammer;
- a back having a plurality of protruding opposable members with a recessed section therebetween forming a saddle-back for releasable engagement with said raised center section of said hammer.

2. The invention in accordance with claim 1 wherein said plurality of protruding opposable members comprise two opposing shoulder sections.

3. The invention in accordance with claim 1 wherein said plurality of protruding opposable members comprises four feet located in each comer of said back of said hammer tip.

4. The invention in accordance with claim 1 wherein said hammer further comprises a ledge for releasable mated engagement with an outside surface of said hammer tip.

5. The invention in accordance with claim 1 wherein said hammer further comprises an upper and lower protruding ledge for releasable mated engagement with a top and bottom of said hammer tip.

6. The invention in accordance with claim 1 wherein said raised center section of said face of said upper body portion of said hammer is formed by partially recessed side grooves.

7. The invention in accordance with claim 6 wherein said partially recessed side grooves of said upper body portion of said hammer are mated for releasable engagement with said opposing members of said hammer tip.

8. The invention in accordance with claim 6, wherein said plurality of protruding opposable members comprise two opposing shoulder sections and, wherein said bolt hole in said hammer tip is recessed to receive a head of said bolt, wherein said partially recessed side grooves of said upper body portion of said hammer, said opposing shoulder sections of said hammer tip and said recessed section therebetween forming said saddle-back, are precision milled to a tolerance between said recessed bolt hole of said hammer tip and said bolt head.

9. The invention in accordance with claim 1 wherein said bolt hole in said hammer tip is recessed to receive a head of said bolt.

10. The invention in accordance with claim 1 wherein said opposable members of said back of said hammer tip have a width of at least 12% of the width of said front face of said hammer.

11. The invention in accordance with claim 1 wherein said recessed section between said opposable members of said back of said hammer tip have a depth of at least 12% of the width of said front face of the said hammer.

12. The invention in accordance with claim 1 further comprising two centrally located bolt holes, and two bolts for releasable engagement of said hammer tip and said hammer.

* * * * *